United States Patent [19]

Braverman

[11] 4,211,329

[45] Jul. 8, 1980

[54] EXTENDER AND HEADER CARD FOR MEDICINAL DISPENSING DEVICE

[76] Inventor: Milton Braverman, Philadelphia, Pa.

[21] Appl. No.: 33,923

[22] Filed: Apr. 27, 1979

[51] Int. Cl.[2] ..... B65D 73/00; B65D 83/04; B65D 85/56

[52] U.S. Cl. ..... 206/534; 206/461; 206/484; 206/534.1; 206/539; 206/806; 206/813; 206/820

[58] Field of Search ..... 206/459, 534, 534.1, 206/538, 539, 461, 530, 820, 484, 813

[56] References Cited

U.S. PATENT DOCUMENTS

| | | | |
|---|---|---|---|
| 1,840,757 | 1/1932 | Watkins | 206/820 X |
| 3,214,013 | 10/1965 | Diamant | 206/484 |
| 3,780,856 | 12/1973 | Braverman | 206/539 |
| 3,827,571 | 8/1974 | Koutny | 206/44 R |
| 3,924,748 | 12/1975 | Braverman | 206/538 X |
| 3,931,884 | 1/1976 | Nahill et al. | 206/820 X |

*Primary Examiner*—Allan N. Shoap
*Attorney, Agent, or Firm*—Caesar, Rivise, Bernstein & Cohen, Ltd.

[57] ABSTRACT

An extender and header card for a medicinal dispensing device and a fixture base converted for filling the same. The device includes a plurality of article-holding units, each having flanges detachably connected along predetermined weakened lines and a chamber depending from each flange. A cover sheet is secured over the chambers and includes perforated lines corresponding to the weakened flange lines to enable each unit to be separated from the other unit. The header card includes a panel having a front face for receipt of prescription indicia thereron, a transverse weakened line extending along a lower edge and a plurality of longitudinal weakened lines extending parallel to one another from the edge of the transverse line to form a plurality of separable sections. Adhesive is provided along the lower edge of the card for securing the card to the dispensing device.

The extender increases the capacity of the medicinal dispensing device and includes a row of article-holding units, constructed like the units of the device. The cover sheet of the extender includes a tab extending beyond the flanges of the row of units and includes a transversely extending weakened line contiguous with the flanges. The underside of the tab includes an adhesive for attaching the extender to the medicinal dispensing device.

9 Claims, 15 Drawing Figures

EXTENDER AND HEADER CARD FOR MEDICINAL DISPENSING DEVICE

This invention relates generally to multi-compartment medicinal dispensing devices and, more particularly, to header cards, extenders and fixture base converters therefor.

In my U.S. Pat. No. 3,780,856, whose disclosure is incorporated by reference herein, there is disclosed and claimed a multi-compartment medicinal dispensing device which is arranged for holding plural doses of medicine therein for subsequent dispensation. The device is arranged to be simply loaded and labeled by hospital or other personnel.

Unlike prior art devices, the device of said patent is arranged for manual unit dose use. To that end, that dispensing device comprises a plurality of individual medicine-holding units, each having flanges thereon. The flanges have corners and are detachably connected along predetermined weakened lines so that each flange may be separated from the remaining flanges to separate the units from one another. Each unit also includes a chamber with an outer opening depending from the flanges of the unit. The chamber is adapted to hold the drug, tablet, capsule or the like therein. A cover sheet having a removable liner sheet is provided, when the liner sheet is removed the cover sheet is secured over the base covering the chamber is provided, with certain portions of the cover sheet in contact with the flanges. The cover sheet is perforated along predetermined lines corresponding to the flange lines to form a plurality of individual closures therebetween. Each closure seals the opening of the chamber in the medicine unit disposed thereunder. Predetermined portions of the cover sheet have an adhesive coating for securement to the flanges, while the areas of the cover sheet disposed immediately over the chamber openings are non-tacky. At least one corner of a flange of each unit is cut away so that the existing corner of the individual closure overlying the cutaway area functions as a lift tab to facilitate the separation of the closure from the flange to which it is connected, to thereby provide access to the contents of the chamber disposed thereunder.

In one embodiment of the invention disclosed in said patent, the article-holding units are provided in five rows of five columns (i.e., five units per row).

A fixture base having an array of five rows and five columns of openings is also disclosed. The openings are adapted to receive respective chambers of the device base to support the base during filling and securement of the cover sheet thereto.

In my U.S. Pat. 3,924,748, whose disclosure is incorporated by reference herein, there is disclosed and claimed an improved closure for the medicinal dispensing device shown and claimed in my U.S. Pat No. 3,780,856.

To that end, in U.S. Pat. No. 3,924,748, tab means are provided along the edge of the cover sheet to facilitate the removal of the liner sheet from the cover sheet before securement to the base. Moreover, striped portions of the inside surface of the cover sheet contiguous with certain perforated lines of the cover sheet do not have an adhesive thereon. Such non-adhesive portions are disposed over the cutaway portions of the flanges of the device base to facilitate the gripping of individual closure members to effect their removal, and the concomittant opening of the chamber disposed thereunder.

While both of my aforementioned patents disclose medicinal dispensing devices which are suitable for the purposes for which they were intended, such devices have somewhat limited utility in certain applications.

For example, while the devices in my aforementioned patents have areas on the cover sheet thereof suitable for carrying some information about the prescription, such devices in and of themself do not readily lend themself to carrying a standard size prescription label on which the complete prescription identification (called "signature") e.g., the name of nursing home or hospital, the patient, the doctor, the medicine, the dosage, etc., or carrying other instructional material or data, e.g., synergistic effects, antagonistic effects, dietary restrictions, etc., is placed.

Accordingly, it is a general object of this invention to provide a header card for securement to a multi-compartment medicinal dispensing device which is suitable for carrying a standard size prescription label thereon.

It is a further object of this invention to provice a header card for securement to a dispensing device as disclosed and claimed in my aforenoted patents and which, after use of all of the units thereof, can serve as a prescription record card.

As is recognized, it is a common practice in the various types of nursing facilities, e.g., convalescent, skilled and extended, as well as in some hospitals, to prescribe and dispense medication on a thirty-day basis since most governmental agencies or insurance carriers follow a thirty-day reimbursement or payment schedule.

Inasmush as the multi-compartment medicinal dispensing devices disclosed in my aforementioned patents are based on a single row of five units or five rows of five units, the capacity of such devices are insufficient for holding a thirty-day prescription.

Accordingly, it is a general object of the instant invention to provide an extender for a multi-compartment medicinal dispensing device to increase the capacity thereof.

It is a further object of this invention to provide an extender which is simple in construction and suitable for use with the devices in my aforenoted patents for securement thereto to increase the capacity thereof.

It is a further object of this invention to provide a converter for use with the fixture base of U.S. Pat. No. 3,780,856 to enable the filling and sealing of a thirty-day capacity dispensing device, e.g., the assembly of a five row, five column despensing device of my prior patent and the extender of the instant invention.

These and other objects of the instant invention are achieved by providing a header card for use with a multi-compartment medicinal dispensing device, an extender for attachment to said medicinal dispensing device to increase the capacity thereof and a fixture base converter for supporting a thirty-day capacity device to facilitate the filling and sealing of the compartments thereof.

The dispensing device includes plural rows of article-holding units, each unit having flanges detachably connected along predetermined weakened lines to enable the units to be separated from each other.

The header card includes a planar panel having a front face, a rear face, a lower edge and an adhesive securement means on the rear face contiguous with the lower edge. The panel includes a transverse weakened line extending across the panel adjacent to the lower edge and a plurality of longitudinal weakened lines extending parallel to one another from the edge to the transverse line to form a plurality of separable sections. The front face of the card includes a first area for receipt of prescription indicia. The card is arranged for securement to the dispensing device, with the adhesive securement means contacting portions of the row of units of the device and with each of the sections of the card disposed over a portion of the flange of a respective unit of the device so that the weakened longitudinal lines of the card are colinear with the weakened flange lines.

The extender includes a row of article-holding units, each with flanges detachably connected along predetermined weakened lines so that each unit can be separated from the other units, a chamber for holding an article therein depending from each flange and closure means in the form of plural closures. Each closure is co-extensive in size with a respective article-holding unit of the device and adapted to seal the opening thereof. The closures are formed by a cover sheet having an exterior surface and an interior surface having an adhesive thereon. The cover sheet includes plural weakened lines defining the closures and corresponding to the flange lines. The cover sheet includes a tab portion extending beyond the flange forming the row of units of the extender and a transversely extending weakened line contiguous with the flange. Adhesive securement means is provided on the interior surface of the flange for securement to the exterior surface of the cover sheet of the medicinal dispensing device.

The fixture base converter is adapted for disposition on a fixture base having a plurality of openings corresponding to the number of units in the dispensing device, e.g., five rows and five columns. The converter comprises a support surface having a plurality of openings therein disposed in an array of six rows and five columns, with five rows and five columns of the converter being disposed directly over five rows and five columns in said base. A downward projecting ledge extends from the converter adjacent the bottom row of openings for disposition on the surface upon which said base is disposed.

Other objects and many of the attendant advantages of this invention will become readily apparent by reference to the accompanying drawings wherein:

FIG. 1 is a plan view of the header card of the instant invention, shown secured to a multi-compartment medicinal dispensing device, like that of U.S. Pat. No. 3,780,856;

Figure 6:
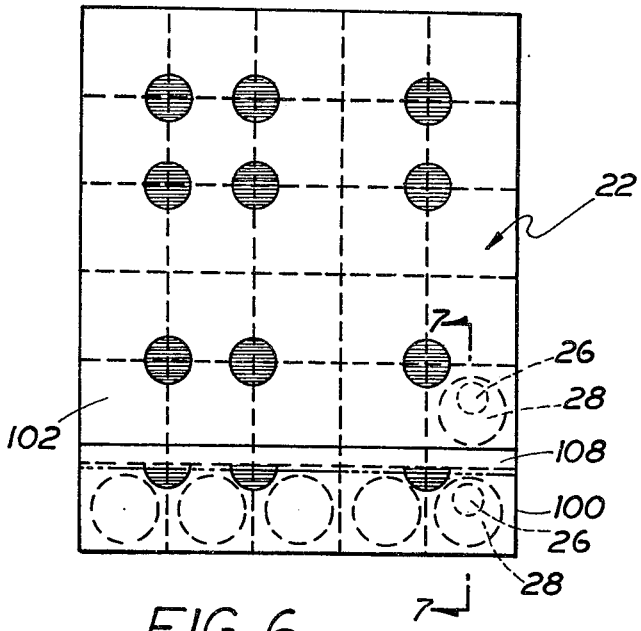
FIG. 6 is a plan view of the assembly of the extender of the instant invention and the multi-compartment medicinal dispensing device shown in FIG. 1.
Figure 13:
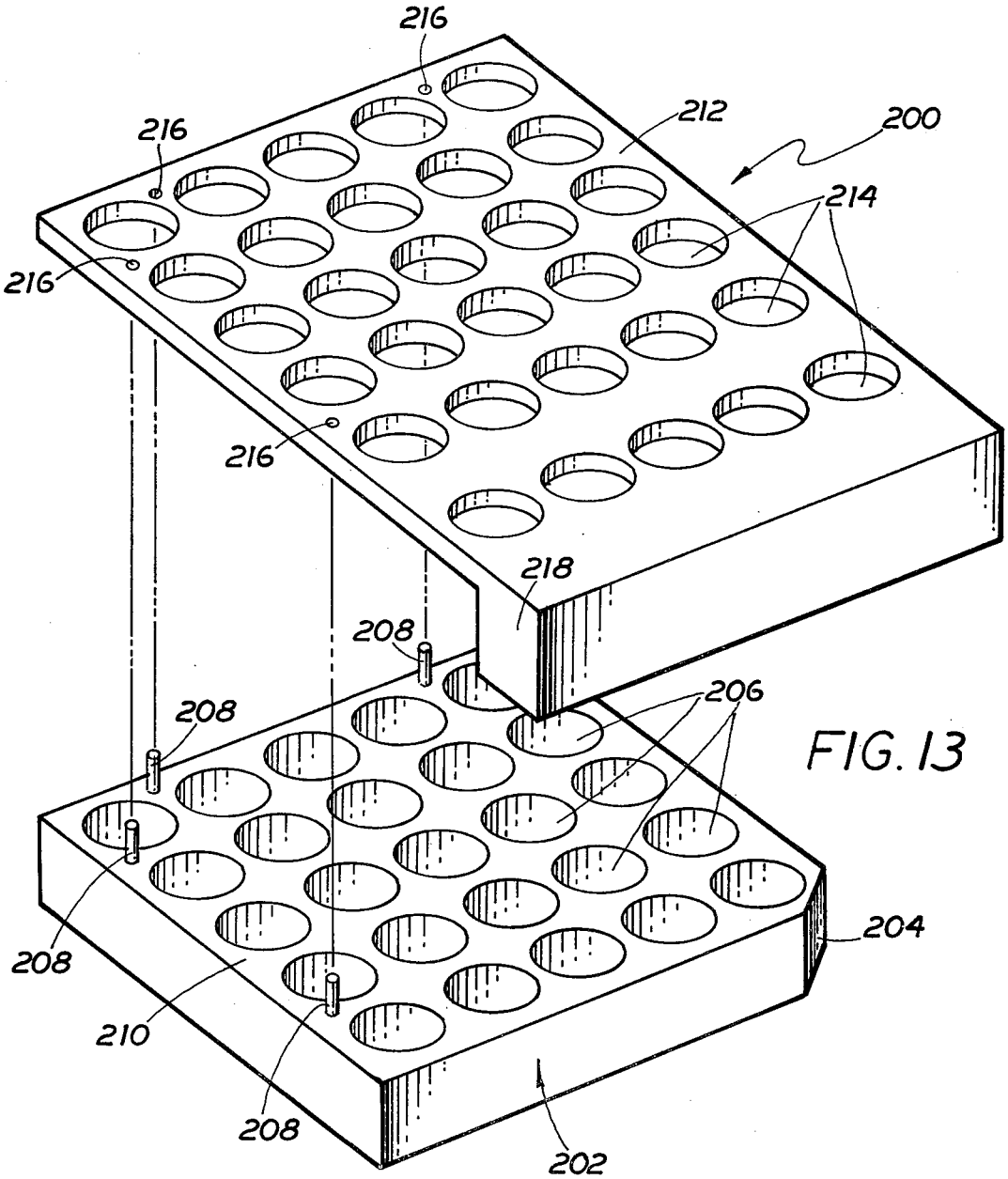
Figure 14:
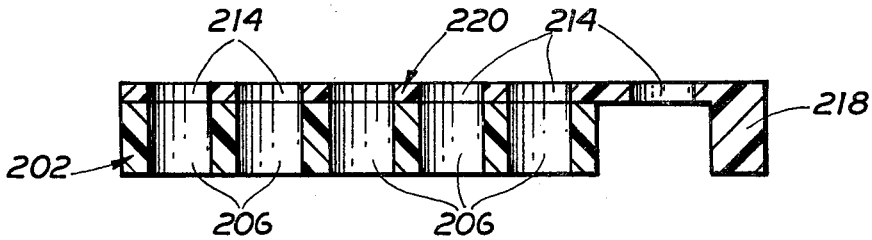
Figure 15:
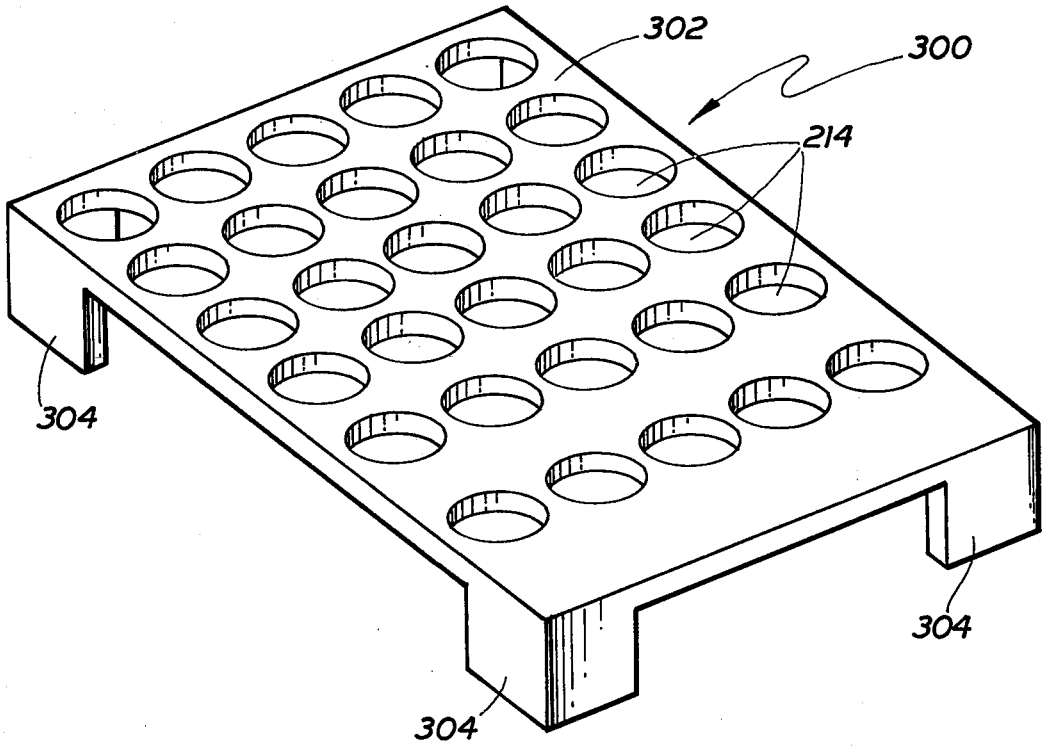

FIG. 13 is an exploded perspective view showning a fixture base converter for use with a fixture base, like that disclosed in U.S. Pat. No. 3,780,856;

FIG. 14 is a longitudinal sectional view showing the assembled converter and base shown in FIG. 13; and FIG. 15 is a perspective view of a unitary fixture base for supporting and facilitating the filling of the assembled extender and dispensing device shown in FIG. 6.

Figure 1:
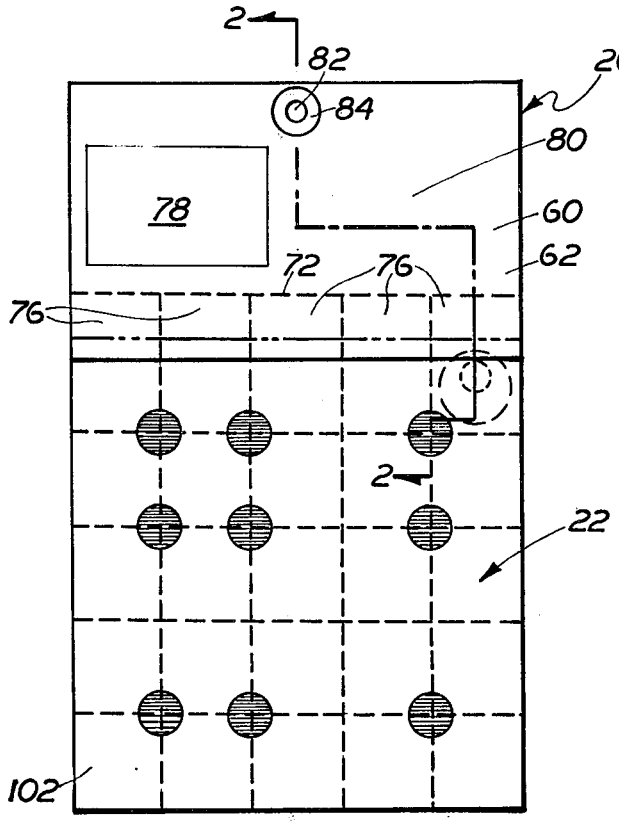

Referring now in greater detail to the various figures of the drawing, wherein like reference characters refer to like parts, there is shown at 20 in FIG. 1 a header card for a multi-compartment medicinal dispensing device 22 like that disclosed and claimed in my aforenoted U.S. Pat. No. 3,780,856.

Figure 7:
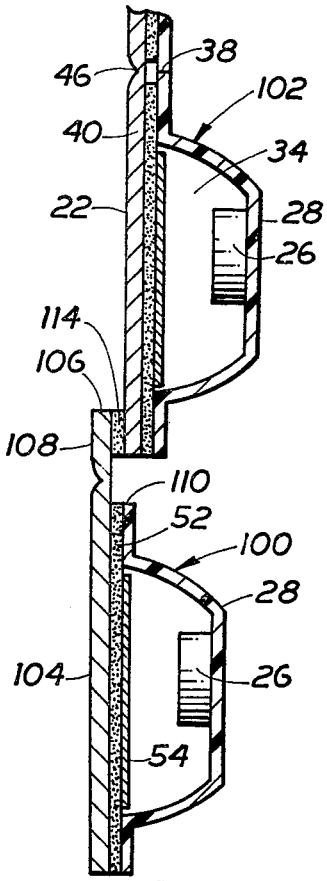
FIG. 7 is an enlarged sectional view taken along line 7—7 of FIG. 6.
Figure 8:
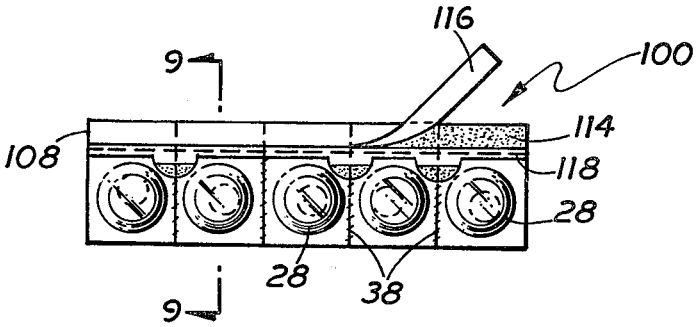
FIG. 8 is a plan view of the underside of the extender shown in FIG. 6.
Figure 9:
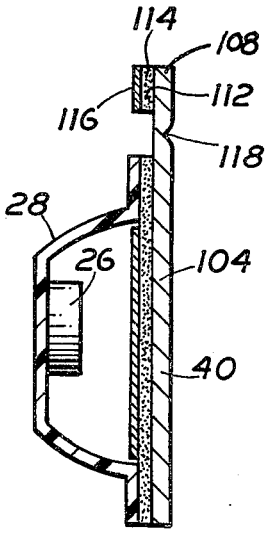
FIG. 9 is an enlarged sectional view taken along line 9—9 of FIG. 8.
Figure 11:
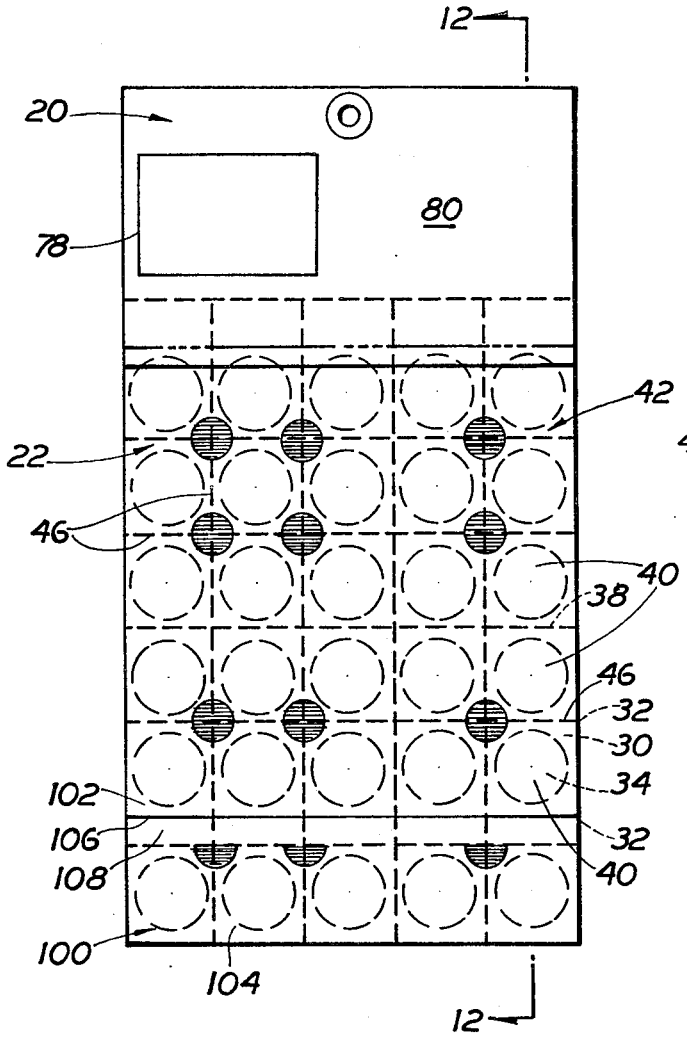
FIG. 11 is a plan view of the assembly of the header card and extender of the instant invention and the medicinal dispensing device shown in FIG. 1.
Figure 12:
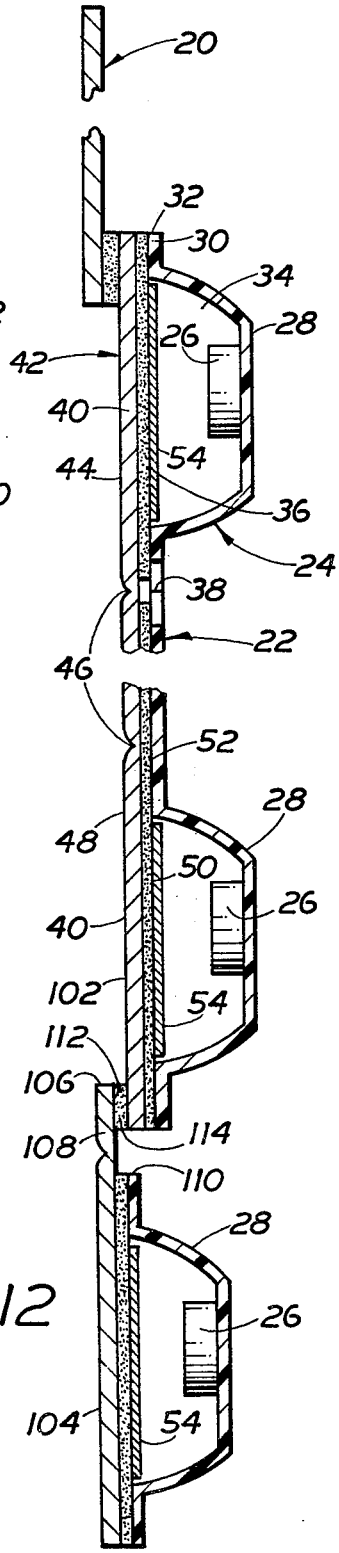
FIG. 12 is an enlarged sectional view taken along line 12—12 of FIG. 11.

Before describing the details of the header card, a brief review of the construction of the dispensing device 22 is in order. To that end, as can be seen in FIGS. 1, 2, 11 and 12, the medicinal dispensing device includes a multi-compartment base member 24 (FIGS. 7, 11 and 12) for holding a plurality of articles or other medicine 26. To that end, the base 24 is formed of a plurality of article-holding units 28. Each unit is of generally rectangular shape and comprises four flanges 30 (FIGS. 7 and 12) having corners 32 and a chamber 34 depending from the flanges. The chamber is bowl-shaped and includes an opening 36 through which the medicament is inserted for disposition within the chamber. The units 28 are detachably connected together by their flanges along intersecting weakened or perforated lines 38 (FIGS. 7 and 11). Each unit has a flange having a cutaway corner.

The contents in the chamber of each unit is sealed therein by a respective closure 40 which is a portion of the improved closure means 42 disclosed and claimed in my aforenoted U.S. Pat. No. 3,924,748. To that end, the closure means 42 comprises a cover sheet 44 which is perforated along intersecting lines 46 corresponding to the flange lines 38. The intersecting lines 46 define the closures 40 therebetween, with each closure being coextensive in size with an associated article-holding unit 28.

When the closure 42 is secured in place the perforated lines 46 overly and are colinear with the flange lines 28, with each closure member 40 being secured in place to the associated flange to seal the opening in the chamber of the underlying article-holding unit.

The units 28 are adapted to be detached from each other along the colinear lines 38 and 46 to provide individual, sealed, article-holding units.

When it is desired to remove the contents of any unit 28, the closure 40 sealing that unit is peeled off at the cutaway flange corner to provide access to the interior of the chamber 34 and the article 26 disposed therein.

The closure means 42 basically comprises two distinct members, the heretofore described cover sheet 44 and a liner sheet (not shown). The liner sheet is coextensive in size with the cover sheet. The cover sheet includes an exterior surface 48 and an interior surface 50 having an adhesive coating 52 thereon. The adhesive coating serves as the means for securing the individual closures 40 of the cover sheet 44 to the flanges 30 of the associated units 28 to seal the article within the units. The liner sheet protects the adhesive on the cover sheet before the cover sheet is secured in place to the flanges. To that end, the liner sheet is temporarily secured to the cover sheet and adapted to be peeled off the cover sheet when the cover sheet is to be secured in place on the multi-compartment base. In order to enable the liner sheet to be readily removed from the cover sheet, the liner sheet is preferably formed of a relatively non-sticky material, such as a glassine-type paper.

The cover sheet is preferably formed of a strong and sturdy paper base. The exterior surface 48 of the cover sheet is coated to be receptive to pencil, ink, multi-lith spirit masters and photo-copy offset so that writing or other indicia can be placed upon the exterior surface of the closures.

The liner sheet includes a plurality of circular portions 54 defined by plural circular die-cut lines. Each portion 54 is adapted to remain affixed to the adhesive coating 52 on the interior surface 50 of the cover sheet after the liner sheet has been removed therefrom to provide a non-adhesive area on the inner surface of each of the closures of the cover sheet. Each non-adhesive circular portion is located over the opening in the respective article-holding unit 28 to preclude the article 26 disposed therein from adhering to the adhesive of the cover sheet when it is secured in place on the base.

As can be seen in FIGS. 1, 6 and 11 the plural article-holding units 28 of the dispensing device 22 are arranged in an array of five rows of five columns. Thus, the device has a total capacity of twenty-five doses of medicine.

Notwithstanding the ability of the outer surface of the closures to accept printing or writing thereon, the device is not amenable to the inclusion of a full prescription "signature" thereon.

The header card 20 of the instant invention, as will be described in detail hereinafter, is arranged for securement to the multi-compartment medicinal dispensing device 22 to carry a full prescription signature thereon, e.g., in the form of a No. 2 prescription label, as well as any other instructional material, special instructions or data. Moreover, once all the units 28 of the dispensing device have been detached from one another and from the header card 22, the card is then suitable for filing to keep a record of the prescription.

As can be seen in FIGS. 1, 2, 4 and 5, the header card 20 basically comprises a planar panel 60, having a front face 62 and a rear face 64. The panel is rectangular in shape and includes a lower edge 66. A band of adhesive 68 is applied to the rear surface 64 of the card contiguous with the lower edge 66. A liner strip 70 of a relatively non-sticky material, such as glassine-type paper, is temporarily secured over the adhesive band 68 and is adapted to be peeled off the band when the header card is to be attached to the multi-compartment medicinal dispensing device 22, as will be described in detail later.

A weakened or perforated line 72 extends transversely across the full width of the header card panel 60 parallel to and closely adjacent the edge 66. A plurality of longitudinal weakened or perforated lines 74 extend parallel to one another from the edge 66 of the panel to the transverse perforated line 72. The transverse line 72 and longitudinal line 74 define therebetween a plurality of separable sections 76. The sections are configured so that when the header card is secured to the dispensing device 22, each section 76 is located over a portion of the flange of the top row of units 28 of the device 22, with the perforated lines 74 colinear with the flange lines 38 and with the transverse perforated line 72 extending beyond the top edge of the device 22.

Figure 2:
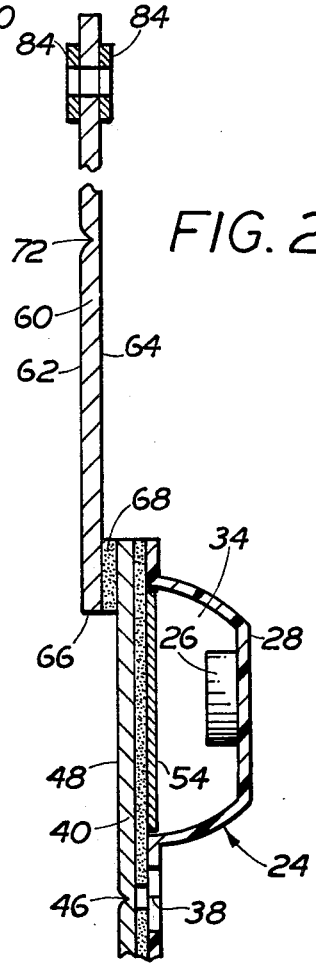
FIG. 2 is an enlarged sectional view taken along line 2—2 of FIG. 1.
Figure 3:
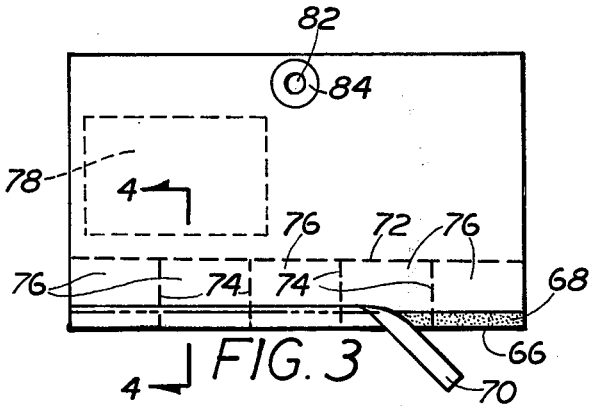
FIG. 3 is a plan view of the underside of the header card shown in FIG. 1.
Figure 4:
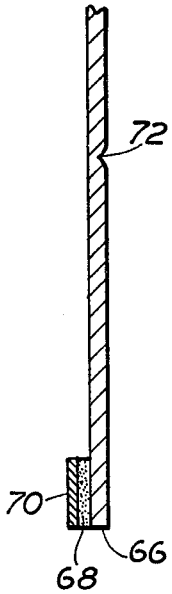
FIG. 4 is an enlarged sectional view taken along line 4—4 of FIG. 3.

The header card 20 is secured to the medicinal dispensing device 22 by removing the liner strip 70 to expose the adhesive band 68 on the underside 64 of the header card. The portion of the header card contiguous with the bottom edge 66 is then brought into engagement with the cover sheet portion contiguous with the top edge of the dispensing device 22 so that the adhesive secured the card to the dispensing device as shown in FIG. 2. Since the perforated lines 74 in the card 20 are colinear with the flange lines separating the units 28 in the top row of the device 22, each unit can be separated from the adjacent unit and from the header card.

The front surface 62 of the panel 60 is sufficiently sized and includes a bounded portion 78 formed by printed indicia defining an area for receipt of a conventional No. 2 size prescription lable carrying a full prescription signature. To the right of the bounded area 78 is an open area 80 on which special instructions, e.g., antagonistic effects of the drug, may be written.

A hold 82 is provided in the panel adjacent the top thereof to serve as a means for hanging the header card and the medicinal dispensing device 22 attached thereto. A pair of reinforcement rings 84 extend about the opening 82 to strengthen the opening.

Figure 5:
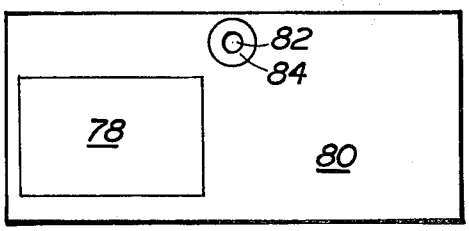
FIG. 5 is a plan view of the header card shown in FIG. 1 after all of the compartments of the medicinal dispensing device of FIG. 1 have been removed therefrom.

Once all the units 28 have been detached from one another and from the card (after all of the doses of medication are used), the card has the appearance like that shown in FIG. 5 and is suitable for filing or other records keeping.

As noted heretofore, the medicinal dispensing device 22 disclosed and claimed in my aforenoted U.S. Pat. No. 3,780,856, has a maximum capacity of 25 individual doses since it includes 25 units 28. Inasmuch as various patient care or nursing facilities provide dosage of medication on a thirty-day basis, the extender as disclosed and claimed herein is constructed for attachment to the device 22 to increase the capacity thereof to 30 doses.

The extender 100 of the instant invention is constructed in a manner similar to that of the medicinal dispensing device 22, except that the extender 100 only includes a single row of five columns of article-holding units 28. In addition, the closure means for the extender includes a tab, to be described later, for attaching the extender to the medicinal dispensing device 22.

The extender 100 is best seen in FIGS. 6–10 and includes a single row of five article-holding units which are constructed in accordance with the teachings of my aforenoted U.S. Pat. No. 3,780,856. More particularly, the base 24 forming the five units is constructed in an identical manner to the base portion forming the lowermost row 102 of the units of the medicinal dispensing device 22.

Figure 10:
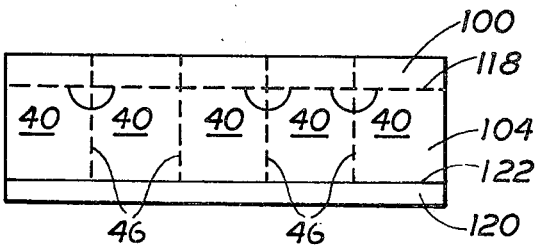
FIG. 10 is a plan view of the front of the extender shown in FIG. 8.

The extender 100 includes closure means 104 which is identical in construction to that portion of the closure secured over the row 102 of the dispenser 22, except that the top edge 106 of the closure means 104 of the extender is in the form of a tab 108. The tab 108 extends beyond the top edge 110 of the extender's base. The underside 112 of a portion of the tab 108 contiguous with the free edge thereof includes a band of adhesive 114. A liner strip 116, formed of a glassine-type material, is temporarily secured over the adhesive band to protect it. A weakened or perforated line 118 extends across the closure tab 108 parallel to but extending beyond the top edge 110 of the extender's base. The underside of the cover sheet contiguous with the perforated lines 118 does not have any adhesive thereon. The weakened line 118 serves as the means for detaching individual units 28 of the extender from one another and from the lowermost row 102 of the device 22 after the extender has been secured thereto. As shown in FIG. 10 the closure 104 includes a strip 120 secured to the liner sheet (not shown) and separated from the individual closures for the extender by a die cut line 122.

The securement of the extender 100 to device 22 to form an assembly having a one-month (30 day) dosage capacity is as follows: The liner sheet (not shown) is removed from the cover sheet of the closure, the medicines are inserted in the chambers and the cover sheet is secured to the extender's base. Then the liner strip 116 on the adhesive band 114 is removed to expose the adhesive. The extender is then located so that the adhesive carried underside of the tab overlies the lowermost flanges of the bottom row 102 of the units of the device 22. Accordingly, the adhesive on the extender secures the extender to the cover sheet portion lying over the lowermost flanges of the dispensing device 22 to form the assembly shown in FIGS. 6 and 7.

It must be pointed out at this juncture that the header card 20 of the instant invention is suitable for securement not only to a medicinal dispensing device 22, like that shown in FIG. 1, but also to the assembly of medicinal dispensing device 22 and an extender 100, as shown in FIGS. 10 and 11.

In FIG. 13 there is shown a fixture base converter 200 constructed in accordance with the instant invention and adapted for converting a fixture base 202, like that disclosed and claimed in aforenoted U.S. Pat. No. 3,780,856, into a fixture for facilitating the filling and sealing of a medicinal dispensing device having thirty article-holding units 28.

Before describing the details of the converter 200, a brief review of the constructional details of the fixture base 202, is in order.

As can be seen in FIGS. 13 and 14, a fixture base 202 is a planar slab of rectangular shape and having a nipped corner 204. The slab 202 includes a plurality of openings 206 extending therethrough. A plurality of spring-loaded pins 208 facilitate the release of a pressure-applying member (not shown) away from the base after the closure is secured to the dispenser base. Since the fixture base 202 is adapted for use with the medicinal dispensing device 22, the openings 206 are arranged in an array of five rows of five columns.

The converter 200 basically comprises a planar support portion 212 of rectangular shape. A plurality of openings 214 extend through the planar supports 212. The openings are provided in an array of six rows of five columns. Plural alignment apertures 216 extend through the planar portion 212 of the converter. The alignment apertures are adapted to receive therein the spring-loaded pins 208 to align the converter on the fixture base 202. The lowermost end of the converter is in the form of a downwardly projecting ledge 218. The ledge 218 is adapted to contact the surface upon which the fixture base 202 is disposed when the converter is in place on the fixture base.

When the converter 200 is located on the fixture base 202 with the pins 208 extending through apertures 216, five rows of five columns of the openings 214 of the converter are disposed over and aligned with the five rows and five columns of openings 206 in the fixture base 202. Accordingly, a working surface 220 having sufficient openings for supporting the thirty article-holding unit base portions of an assembled dispensing device 22 and extender 100 or of a unitary, thirty-day medicinal dispensing device (not shown) results. Thus, persons having a fixture base with a capacity of twenty-five units, like that of fixture base 202, need not discard that base but can, with the addition of the converter 200, convert said base into one suitable for use in filling and sealing thirty-day capacity medicinal despensing devices.

In FIG. 15 there is shown an integral fixture base for effecting the filling and sealing of thirty-day capacity medicinal dispensing devices. To that end, the fixture base 300 shown in FIG. 15 comprises a planar support portion 302 constructed like the support portion 212 of the extender 200, but without any alignment holes 216 therein. Projecting downward from each corner of the planar support portion 302 is a support leg 304 for supporting the fixture on a surface.

As should be appreciated from the foregoing, the header card of the instant invention provides a convenient means for carrying various written material, e.g., a prescription signature, special instructions, etc., as may be required in care or nursing facilities. Moreover, the construction of the card enables it to be used as a record keeping medium after all of the medicine-holding units are detached therefrom.

The extender of the instant invention provides a convenient means for increasing the capacity of the multi-compartment medicinal dispensing device disclosed in my aforementioned patent to one capable of holding thirty doses of medicine.

The converter of the instant invention allows the ready retrofit of support fixtures, like disclosed in my aforementioned patent, to accommodate thirty-day capacity medicinal dispensing devices.

Without further elaboration, the foregoing will so fully illustrate my invention that others may, by applying current or future knowledge, readily adapt the same for use under various conditions of service.

What is claimed as the invention is:

1. A header card for a medicinal dispensing device having a row of article holding units therein, each unit having flanges detachably connected along predetermined weakened lines so that each unit can be separated from other units, said card comprising a planar panel having a front face, a rear face, a lower edge and adhesive securement means disposed on the rear face contiguous with the lower edge, said panel including a transverse weakened line extending across the panel spaced from the lower edge and a plurality of longitudinal weakened lines extending parallel to one another from said edge to the transverse line to form a plurality of separable sections, the front face of said card including a first area for receipt of prescription indicia, said card being arranged for securement to said dispensing device with the adhesive securement means contacting portions of said row of units, which each of the sections of said card being disposed over a portion of the flange of a respective unit and with the weakened longitudinal lines of the card being aligned with the weakened flange lines.

2. The header card of claim 1 wherein said front face includes a second area for receipt of instructional indicia.

3. The header card of claim 2 additionally comprising an opening in said panel for hanging said card.

4. The header card of claim 3 additionally comprising a liner strip releasably secured to said adhesive securement means.

5. An extender for a medicinal dispensing device, said device including a plurality of article holding units, each having flanges detachably connected along predetermined weakened lines so that each unit can be separated from other units, a chamber for holding an article therein depending from each flange and having an opening for the chamber, a cover sheet having interesecting weakened lines corresponding to the flange lines and forming a plurality of closures sealing respective openings in said units, said extender including a row of article-holding units, each with flanges detachably connected along predetermined weakened lines so that each unit can be separated from the other units, a chamber for holding an article therein depending from each flange, and closure means in the form of plural closures, each being coextensive in size with a respective article holding unit and adapted to seal the opening in a said unit, said closures being formed by a cover sheet having an exterior surface and an interior surface having a adhesive thereon said cover sheet including plural weakened lines defining said closures and corresponding to the flange lines and including a tab portion extending beyond the flanges forming said row, said tab including a transversely extending weakened line contiguous with said flanges, and adhesive securement means on the interior surface thereof for securement to the exterior surface of the cover sheet of the medicinal dispensing device.

6. The extender of claim 5 wherein said extender includes a liner strip releasably secured to the adhesive securement means of said tab.

7. A medicinal dispensing device comprising a row of plural article-holding unit, each unit having flanges and detachably connected along predetermined weakened lines so that each unit can be separated from other units, a chamber for holding an article therein depending from each flange and having an opening for the chamber, a cover sheet having intersecting weakened lines corresponding to the flange lines and forming a plurality of closures sealing respective openings in said units, an extender secured to said row and including a row of article holding units, each with flanges detachably connected along predetermined weakened lines so that each unit can be separated fron the other units, a chamber for holding an article therein depending from each flange, and closure means in the form of plural closures, each being coextensive in size with a respective article holding unit and adapted to seal the opening in said unit, said closures being formed by a cover sheet and a liner sheet, said cover sheet having an exterior surface and an interior surface having an adhesive thereon temporarily securing the liner sheet to the cover sheet, said cover sheet including plural weakened lines defining said closures and corresponding to the flange lines and including a tab portion extending beyond the flanges forming said row, said tab including a transversely extending weakened line contiguous with said flanges, and adhesive securement means on the interior surface thereof for securement to the exterior surface of the cover sheet of the medicinal dispensing device, and a header card for securement to a row of said article holding units, said header card comprising a planar panel having a front face, a rear face, a lower edge and adhesive securement means disposed on the rear face contiguous with the lower edge, said panel including a transverse weakened line extending across the panel spaced from the lower edge and a plurality of longitudinal weakened lines extending parallel to one another from said edge to the transverse line to form a plurality of separable sections, the front face of said card including a first area for receipt of prescription indicia, said card being arranged for securement to said dispensing device with the adhesive securement means contacting portions of said row of units, with each of the sections of said card being disposed over a portion of the flange of a respective unit and with the weakened longitudinal lines of the card being aligned with the weakened flange lines.

8. The medicinal dispensing device of claim 7 wherein said front face includes a second area for receipt of instructional indicia.

9. The medicinal dispensing device of claim 8 wherein said card includes an opening in said panel for hanging the device.

* * * * *